US008992758B2

(12) United States Patent
Dudley et al.

(10) Patent No.: US 8,992,758 B2
(45) **Date of Patent: *Mar. 31, 2015**

(54) APPARATUS AND METHOD FOR REDUCTION OF A SOLID FEEDSTOCK

(75) Inventors: Peter G. Dudley, Hickleton (GB); Allen Richard Wright, Gunnerton (GB)

(73) Assignee: Metalysis Limited (GB)

( * ) Notice: Subject to any disclaimer, the term of this patent is extended or adjusted under 35 U.S.C. 154(b) by 392 days.

This patent is subject to a terminal disclaimer.

(21) Appl. No.: 13/320,076

(22) PCT Filed: May 12, 2010

(86) PCT No.: PCT/GB2010/000960

§ 371 (c)(1),
(2), (4) Date: Feb. 27, 2012

(87) PCT Pub. No.: WO2010/131000

PCT Pub. Date: Nov. 18, 2010

(65) Prior Publication Data

US 2012/0138475 A1 Jun. 7, 2012

(30) Foreign Application Priority Data

May 12, 2009 (GB) ..... 0908151.4
May 12, 2009 (GB) ..... 0908152.2

(51) Int. Cl.
*C25C 7/00* (2006.01)
*C25C 3/00* (2006.01)
*C25C 3/28* (2006.01)
(Continued)

(52) U.S. Cl.
CPC . *C25C 7/005* (2013.01); *C25C 3/00* (2013.01); *C25C 3/28* (2013.01); *C22B 4/08* (2013.01); *C22B 5/02* (2013.01); *C22B 34/129* (2013.01); *C25C 7/00* (2013.01)
USPC ..... 205/367; 204/237; 204/239

(58) Field of Classification Search
None
See application file for complete search history.

(56) References Cited

U.S. PATENT DOCUMENTS 3,640,801 A * 2/1972 Love ..... 205/342
3,755,099 A 8/1973 Haupin
(Continued)

FOREIGN PATENT DOCUMENTS

EP 0 257 710 3/1988
EP 1 876 248 1/2008
(Continued)

OTHER PUBLICATIONS

Ishikawa, T. et al. "Application of a Vertically Stacked Bipolar Electrode Cell to Electrowinning of Liquid Magnesium from Chloride Melts" *Electrochemistry*, 1997, vol. 65, No. 12, pp. 1080-1085.
(Continued)

*Primary Examiner* — Harry D Wilkins, III
(74) *Attorney, Agent, or Firm* — Saliwanchik, Lloyd & Eisenschenk

(57) ABSTRACT

In a method for reduction of a solid feedstock, such as a solid metal compound, in an electrolytic apparatus a portion of the feedstock is arranged in each of two or more electrolytic cells (50, 60, 70, 80). A molten salt is provided as an electrolyte in each cell. The molten salt is circulated from a molten salt reservoir (10) such that salt flows through each of the cells. Feedstock is reduced in each cell by applying a potential across electrodes in each cell, the potential being sufficient to cause reduction of the feedstock. The invention also provides an apparatus for implementing the method.

30 Claims, 5 Drawing Sheets

(51) Int. Cl.

| | |
|---|---|
| ***C22B 4/08*** | (2006.01) |
| ***C22B 5/02*** | (2006.01) |
| ***C22B 34/12*** | (2006.01) |

(56) References Cited

U.S. PATENT DOCUMENTS

| | | | | |
|---|---|---|---|---|
| 3,979,267 | A * | 9/1976 | Townsend | 205/101 |
| 4,154,661 | A | 5/1979 | Hyland et al. | |
| 4,308,114 | A | 12/1981 | Das et al. | |
| 4,400,247 | A | 8/1983 | Ginatta | |
| 4,414,089 | A | 11/1983 | McMonigle et al. | |
| 5,089,094 | A | 2/1992 | Ogasawara et al. | |
| 5,935,394 | A | 8/1999 | Sivilotti et al. | |
| 2004/0159559 | A1 | 8/2004 | Fray et al. | |
| 2004/0173470 | A1 * | 9/2004 | Strezov et al. | 205/401 |
| 2006/0049060 | A1 | 3/2006 | Hori | |

FOREIGN PATENT DOCUMENTS

| | | |
|---|---|---|
| EP | 1 942 210 | 7/2008 |
| GB | 1 568 499 | 5/1980 |
| IT | 1188878 | 1/1988 |
| JP | 3236486 | 10/1991 |
| JP | 5263285 | 10/1993 |
| JP | 2009197277 | 9/2009 |
| WO | WO 99/64638 | 12/1999 |
| WO | WO 00/03068 | 1/2000 |
| WO | WO 03/002785 | 1/2003 |
| WO | WO 2004/113593 | 12/2004 |
| WO | WO 2005/031041 | 4/2005 |
| WO | WO 2008/101283 | 8/2008 |
| WO | WO 2010/130995 | 11/2010 |
| WO | WO 2012/066297 | 5/2012 |
| WO | WO 2012/066299 | 5/2012 |

OTHER PUBLICATIONS

Kusakabe, K. et al. "Current Paths and Electrolysis Efficiency in Bipolar Packed-Bed Electrodes" *Journal of Chemical Engineering of Japan*, 1982, vol. 15, No. 1, pp. 45-50.

* cited by examiner

APPARATUS AND METHOD FOR REDUCTION OF A SOLID FEEDSTOCK

CROSS-REFERENCE TO RELATED APPLICATION

This application is the National Stage of International Application Number PCT/GB2010/000960, filed May 12, 2010, which is hereby incorporated by reference herein in its entirety, including any figures, tables, nucleic acid sequences, amino acid sequences, or drawings.

The invention relates to an apparatus and a method for the reduction of a solid feedstock, in particular for the production of metal by reduction of a solid metal oxide.

BACKGROUND

The present invention concerns the reduction of solid feedstock comprising metal compounds, such as metal oxides, to form products. As is known from the prior art, such processes may be used, for example, to reduce metal compounds or semi-metal compounds to metals, semi-metals or partially-reduced compounds, or to reduce mixtures of metal compounds to form alloys. In order to avoid repetition, the term metal will be used in this document to encompass all such products, such as metals, semi-metals, alloys, intermetallics and partially reduced products.

In recent years there has been great interest in the direct production of metal by reduction of a solid feedstock, for example, a solid metal oxide feedstock. One such reduction process is the Cambridge FFC electro-decomposition process (as described in WO 99/64638). In the FFC method a solid compound, for example a solid metal oxide, is arranged in contact with a cathode in an electrolytic cell comprising a fused salt. A potential is applied between the cathode and an anode of the cell such that the solid compound is reduced. In the FFC process the potential that reduces the solid compound is lower than a deposition potential for a cation from the fused salt. For example, if the fused salt is calcium chloride then the cathode potential at which the solid compound is reduced is lower than a deposition potential for depositing calcium from the salt.

Other reduction processes for reducing feedstock in the form of cathodically-connected solid metal compounds have been proposed, such as the Polar process described in WO 03/076690 and the process described in WO 03/048399.

While the reduction of solid feedstock to metal in an electrolytic cell comprising a molten salt has been carried out for a number of years on a laboratory scale, it has not proved easy to scale up production to an industrial level.

In a typical electrolytic reduction process the electrolytic cell comprises a cathode, an anode and a feedstock arranged in contact with a molten salt. The salt is heated to a molten state within the cell and during the reduction process the salt becomes contaminated with elements evolved from the feedstock and by reactions with the containment materials and electrodes. When performing an electrolytic reduction using such a cell, the entire cell needs to be heated to a temperature at which the salt is molten, which takes a considerable amount of energy and time. Once the reduction is complete the entire cell including the salt needs to be cooled and energy that has been put into the system to heat the salt is lost.

It is an aim of the invention to provide an improved apparatus and method for the electrolytic reduction of solid feedstock.

SUMMARY OF INVENTION

The invention provides an apparatus and method as defined in the appended independent claims to which reference should now be made. Preferred or advantageous features of the invention are set out in dependent sub-claims.

Thus, a first aspect of the invention may provide a method of reducing a solid feedstock, for example a method of producing metal by reduction of a solid feedstock in an electrolytic apparatus. The method comprises the steps of arranging a portion of a feedstock in each of a plurality of electrolytic cells, preferably in contact with a cathode or cathodic element in each of a plurality of electrolytic cells, circulating molten salt from a molten salt reservoir such that salt flows through the electrolytic cells, and applying a potential across the electrodes of each of the cells. The applied potential is sufficient to cause reduction of the feedstock within the cell, for example reduction of the feedstock to metal. It is preferable that each electrolytic cell comprises an anode and a cathode coupled to an electricity supply to enable a potential to be applied between the anode and the cathode in order to effect reduction of the feedstock.

Advantageously, the method may comprise the step of switching the flow of molten salt through the cells from a first salt contained in the first reservoir to a second salt contained in a second reservoir. The composition of the second salt may be different from that of the first salt.

The use of different salt compositions for different stages of the reduction may have a number of advantages as described below. For example, this method may advantageously allow a low oxygen level metal to be formed at a higher rate by using a first salt containing a higher level of dissolved oxygen ions in order to initiate a reduction reaction, and then switching to a second salt having a lower level of oxide ions in order to remove the final portion of oxygen from the reduced product.

In a further advantage, it may be possible to produce reduced products that have been doped with elements, for example with boron or with phosphorus, by initially performing the reduction using a clean salt and then, at the final stages of reduction, switching to a salt that contains a predetermined level of the required element as an impurity. The impurity/dopant element may then infiltrate the reduced product to provide a doped product.

It may also be possible to maintain salt in different reservoirs at different temperatures in order to influence the reaction rates of the reduction reaction.

The method may involve switching the flow of molten salt between more than two reservoirs, for example, between three reservoirs or four reservoirs during the reduction reaction.

The method may advantageously comprise a step of removing an electrolytic cell from the apparatus after completion of a reduction reaction, and replacing the removed cell with a fresh cell containing unreduced feedstock. Preferably the replacement of the cell takes place while molten salt continues to flow through other cells of the apparatus. Replacement of a cell may involve physical removal and replacement of a cell or only the diversion of salt flow from the removed cell to a replacement cell elsewhere in the apparatus.

The apparatus may at any one time include electrolytic cells containing feedstock at different stages of reduction. Some cells may contain fresh unreduced feedstock, some cells may contain partially reduced feedstock, and some cells may contain fully reduced feedstock. The invention may thus make it possible to continuously reduce feedstock by constant replacement of cells as the reduction reaction in those cells reaches completion.

Preferably the molten salt level in the first or each salt reservoir is maintained at a predetermined level. This step may be of particular advantage where electrolytic cells are constantly being replaced within the apparatus as some molten salt will be lost with each replacement.

Advantageously, the molten salt in the, or each, molten salt reservoir may be circulated through a purification system to remove unwanted impurities in the salt and maintain the composition of the salt in the reservoir. Such purification systems may include filtration and electrolysis processes.

Preferably, the reduction of the feedstock occurs by electro-decomposition. Electro-decomposition, particularly of a metal oxide or mixture of metal oxides (electro-deoxidation), is a method that produces metal directly from a solid feedstock comprising a solid metal compound.

A second aspect of the invention may provide an apparatus for the reduction of a solid feedstock, for example an apparatus for the production of metal by reduction of a solid feedstock. Preferably the apparatus comprises a plurality of electrolytic cells each having electrodes and containing a portion of solid feedstock, and a first molten salt reservoir from which molten salt can be circulated such that salt flows through each of the electrolytic cells.

A potential may be applied across the electrodes of each cell to initiate the reduction reaction, the potential being sufficient to cause the reduction of the solid feedstock.

Preferably, each electrolytic cell comprises a housing having a molten salt inlet, a molten salt outlet, an anode positioned within the housing and a cathode positioned within the housing. Thus, the potential may be applied between the anode and the cathode of the cell.

Preferably, a portion of the solid feedstock is retained in contact with a cathode or a cathodic element in each of the plurality of electrolytic cells.

The apparatus may comprise at least one molten salt transport circuit for circulating molten salt. Such a circuit will comprise a conduit or pipework suitable for transferring a flow of molten salt, at temperatures that may be between 200° C. and 1200° C. or between 600° C. and 1200° C., from the reservoir to one or more electrolytic cell, and back to the reservoir. The, or each, salt transport circuit may also comprise, a pump, and/or filters, and/or valves for regulating the flow of salt. More than one salt transport circuit may advantageously be used, depending on the configuration of the apparatus.

It is preferable that the salt is pumped around the molten salt circuit or circuits. It may be possible, however, to arrange the system or apparatus such that a portion of the, or each, circuit is gravity fed. For example, the main salt reservoir may be positioned higher than the cells and the salt may flow through the cells under the influence of gravity.

An advantage of this apparatus is that the salt may be heated in a salt reservoir designed to heat and maintain a molten salt and then this salt may be supplied to one or more of the plurality of electrolytic cells, which may be discrete electrolytic cells. The salt in the reservoir may advantageously be maintained at an appropriate predetermined temperature, for example at a working temperature for a reduction reaction, and then passed directly to an electrolytic cell when that cell has been prepared for reduction. When a reduction reaction has completed in an electrolytic cell of the apparatus, that cell may be drained of molten salt and cooled. The salt in the salt reservoir need not be cooled each time a reduced feedstock is recovered from a cell and, therefore, need not lose its heat energy. If the salt in the reservoir is maintained at or near working temperature for a particular reduction reaction, it may be supplied directly to another cell for use in another reduction reaction.

The use of a separate molten salt reservoir may have further advantages. The composition of the molten salt within the salt reservoir may be monitored and maintained within predetermined limits. In a typical prior art electrolytic cell, all of the molten salt is contained within the cell within which reduction is occurring. Thus, the salt can quickly become contaminated with impurities from the feedstock being reduced, and from reaction with the cell itself, for example reaction with containment materials and/or electrodes. As the reduction proceeds, the levels of impurities within the molten salt tend to rise. It is an advantage of the present invention that a flow of salt is provided through the housing of each electrolytic cell comprised in the apparatus. Thus, the molten salt within each cell is constantly being replenished and replaced by fresh salt. Contaminants are taken away from the reaction area surrounding the feedstock by the flow of salt and this, advantageously, may help prevent the reduced product from being contaminated and may speed up the rate of the reduction reaction.

By including monitoring, filtration and/or purification elements within the, or each, molten salt transport circuit and/or the reservoir itself, or within a separate salt purification circuit, it may be possible to maintain the composition of the molten salt within a predetermined compositional range during the reduction process. This may be particularly advantageous where the reduction process is being used to manufacture a metal that is intolerant of impurities such as oxygen or carbon, for example in the manufacture of titanium or tantalum.

It is preferable that the volume of salt within the salt reservoir is equal to or greater than the total volume of salt within the plurality of electrolytic cells and the molten salt circuit. Preferably the volume of salt in the reservoir is more than double or treble this volume.

The impurities formed during the electrolytic reduction are effectively diluted by the fact that there is a greater volume of salt in the system than in a typical prior art electrolytic reduction system. As the volume of salt in the system is high compared to the amount of feedstock being reduced, the negative effect that any impurities may have on the processing kinetics or on the purity of the reduced product may be ameliorated.

Advantageously, the apparatus may comprise a second salt reservoir for supplying a flow of a second molten salt to the plurality of cells. The second salt reservoir is preferably coupled to the same salt transport circuit or circuits as the first salt reservoir, and valves in these circuits may then allow the source of molten salt flowing through the cells to be switched from the first reservoir to the second reservoir and vice versa.

Alternatively, the second salt reservoir may have its own separate molten salt transport circuit or circuits with its own inlets and outlets to each of the plurality of electrolytic cells.

One advantage of the use of a second salt reservoir may be to allow the salt composition within the electrolytic cells to be changed during the electrolysis process. As an example, when using the FFC process for electrolytic reduction of a metal oxide it may be advantageous to begin the process using a molten salt that contains a relatively high concentration of oxide ions, for example a calcium chloride salt containing dissolved calcium oxide, preferably between 0.2 and 1.0 weight % and more preferably between 0.3 and 0.6 wt % dissolved calcium oxide. The presence of calcium oxide within the melt appears to allow the electro-decomposition reaction to initiate relatively easily. For the production of some metals, for instance tantalum, the oxygen content in the end product needs to be low, and the presence of a high concentration of oxide ions within the molten salt may prevent the desired low level of oxygen from being produced in the metal.

By using a second reservoir of molten salt it becomes possible to initiate an electro-decomposition reaction using a molten salt with relatively high oxide content and then switch the salt source to end the reaction using a salt with a low oxide concentration. Thus, where the first salt comprises calcium chloride containing dissolved calcium oxide, the second salt may comprise calcium chloride with substantially no calcium oxide dissolved in the salt. Such a switch of salt source may advantageously allow the oxygen levels in the final product to be reduced significantly while allowing the overall reaction to be initiated and to proceed at an economically viable rate.

There may be other reasons for wanting to switch salt sources during a reduction reaction. It may be that the salt source in the first reservoir has become contaminated during the electrolytic processing and a switch to a second salt source, thereby supplying fresh uncontaminated salt to the electrolytic cells, may allow the production of metals that are low in contaminants.

Conversely, it may be desirable to switch to a salt supply that contains certain deliberate contaminants or dopants which may then be incorporated or dissolved into the reduced product. For example, it may be advantageous to dope certain metals with trace quantities of impurities, and a convenient way of producing such doped material may be to bathe the material in a salt contaminated with the dopant material for a final portion of the reduction process.

The apparatus may comprise more than two salt reservoirs, for example three or four salt reservoirs, each capable of containing a salt having a different composition for use during the reduction process.

Advantageously, each of the cells may be individually removably-couplable to the salt transport circuit supplying that cell. Thus, it may be possible to shut off the salt supply to a particular electrolytic cell while maintaining a flow of salt through the remaining electrolytic cells. The cell in which the flow has been shut off may then be removed from the circuit altogether. This ability to take an electrolytic cell offline without affecting other electrolytic cells that are undergoing electrolytic reduction reactions may allow the development of a semi-continuous process.

In a typical prior art electrolytic reduction process, the salt electrolyte needs to be brought up to its working temperature from cold for every electrolytic reaction performed in the cell. After the electrolytic reaction has finished the salt must be cooled. Heating and cooling require a considerable amount of both energy and time. Advantageously, both energy and time may be saved by using an apparatus having the ability to maintain molten salt at a predetermined temperature and preferably at a predetermined composition for an extended period of time independently from the reaction cell or cells. When the reduction process has finished in any particular cell, that cell may be removed from the system, or drained and then removed from the system to allow the reduced feedstock to be removed. Advantageously, a new electrolytic cell containing unreduced feedstock may replace the removed electrolytic cell almost immediately after it has been removed.

To allow each cell to be independently removably-couplable to the apparatus, the salt transport circuit or circuits may comprise valves that are actuatable to selectively restrict salt flow to and from each cell. Thus, each cell may be exchanged while the apparatus is in operation.

It may be advantageous that the apparatus comprises means for purification of the molten salt in the reservoir, or reservoirs. Such purification means may include filtration of the salt to remove any scum or slag or particulates that have formed in the salt. Purification may also comprise means for removing undesirable elements, for example the apparatus may include getters to remove any excess dissolved oxygen from the salt.

Means for purification may further comprise means for electrolysis of the salt to remove impurities that are formed during reduction of the feedstock or that the salt has picked up from the atmosphere. In this way, the composition of the salt within the, or each, salt reservoir may be maintained within certain predefined limits and may help make the reduction reaction consistent and controllable.

It may be advantageous for the purification means to be incorporated within a purification circuit. Thus, salt may flow out of the, or each, reservoir, pass through one or more purification elements or apparatus, and flow back into the, or each, reservoir.

Levels of salt within the system may be reduced each time one of the electrolytic cells is removed from the circuit. Even if the cell is drained prior to being taken offline, which is not essential, there will be some salt that is retained on internal surfaces of the cell and on the reduced product. Thus, it may be advantageous for the apparatus to further comprise a top-up salt reservoir for supplying fresh molten salt to the, or each, salt reservoir.

Bringing room temperature salt up to a working temperature (which may be of the order of between 750° C. and 1200° C.) may involve several hours of slow heating. Once at a working temperature the fresh salt may need to be purified for example by chemical or electrolytic treatment in order to remove any water that the salt may have picked up from the atmosphere. Thus, a top-up salt reservoir may advantageously allow fresh salt to be heated up to a working temperature and treated to provide a working composition, in separation from the main salt reservoir. After this heating and preparation has been carried out, the fresh molten salt may be added to the, or each, salt reservoir of the apparatus in order to maintain salt levels.

In use the molten salt may contain a number of different ionic species. When the apparatus is in operation, there is a risk that there may be an electrical connection set up via the molten salt between the cells and the reservoir. Any such electrical connection may be undesirable as it may significantly increase the risk of corrosion of the salt reservoir or elements of the apparatus such as the salt transport circuit and thereby the contamination of the salt.

To address this problem the molten salt circuit may advantageously comprise a return portion or section for returning molten salt from the cells to the, or each, reservoir, in which the salt flow is broken during the return portion to prevent electrical connection between the cells and reservoir or reservoirs. Such break of liquid flow may be achieved by simply dropping the salt into the reservoir from a height at which the flow is disrupted, or it may be achieved by means of incorporating a weir into the liquid flow path of the return portion.

The apparatus as described according to the second aspect of the invention, may be advantageously used with any form of electrolytic cell for reduction of a feedstock. The apparatus may be particularly advantageous for use with an electrolytic cell that comprises a plurality of bipolar elements in which one surface of each of the bipolar elements acts as a cathode. The use of an electrolytic cell comprising bipolar elements may advantageously increase the volume of feedstock that may be reduced in each electrolytic cell and, by using an apparatus having a plurality of such bipolar cells, the apparatus may be more attractive for use on an industrial scale as described in the applicant's co-filed PCT patent application, which claims priority from GB 0908152.2, both of which applications are incorporated herein by reference, in their entirety.

The various aspects of the invention as described above lend themselves particularly well to the reduction of large batches of solid feedstock, on a commercial scale. In particular, embodiments comprising a vertical arrangement to of the bipolar elements within the apparatus allow a large number of bipolar elements to be arranged within a small plant footprint, effectively increasing the amount of reduced product that can be obtained per unit area of a processing plant.

The methods and apparatus of the various aspects of the invention described above are particularly suitable for the production of metal by the reduction of a solid feedstock comprising a solid metal oxide. Pure metals may be formed by reducing a pure metal oxide and alloys and intermetallics may be formed by reducing feedstocks comprising mixed metal oxides or mixtures of pure metal oxides.

Some reduction processes may only operate when the molten salt or electrolyte used in the process comprises a metallic species (a reactive metal) that forms a more stable oxide than the metallic oxide or compound being reduced. Such information is readily available in the form of thermodynamic data, specifically Gibbs free energy data, and may be conveniently determined from a standard Ellingham diagram or predominance diagram or Gibbs free energy diagram. Thermodynamic data on oxide stability and Ellingham diagrams are available to, and understood by, electrochemists and extractive metallurgists (the skilled person in this case would be well aware of such data and information).

Thus, a preferred electrolyte for a reduction process may comprise a calcium salt. Calcium forms a more stable oxide than most other metals and may therefore act to facilitate reduction of any metal oxide that is less stable than calcium oxide. In other cases, salts containing other reactive metals may be used. For example, a reduction process according to any aspect of the invention described herein may be performed using a salt comprising lithium, sodium, potassium, rubidium, caesium, magnesium, calcium, strontium, barium, or yttrium. Chlorides or other salts may be used, including mixture of chlorides or other salts.

By selecting an appropriate electrolyte, almost any metal oxide may be capable of reduction using the methods and apparatuses described herein. In particular, oxides of beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, and the lanthanides including lanthanum, cerium, praseodymium, neodymium, samarium, and the actinides including actinium, thorium, protactinium, uranium, neptunium and plutonium may be reduced, preferably using a molten salt comprising calcium chloride.

The skilled person would be capable of selecting an appropriate electrolyte in which to reduce a particular metal oxide, and in the majority of cases an electrolyte comprising calcium chloride will be suitable.

SPECIAL EMBODIMENTS OF THE INVENTION

Specific embodiments of the invention will now be described with reference to figures in which.

Figure 1:
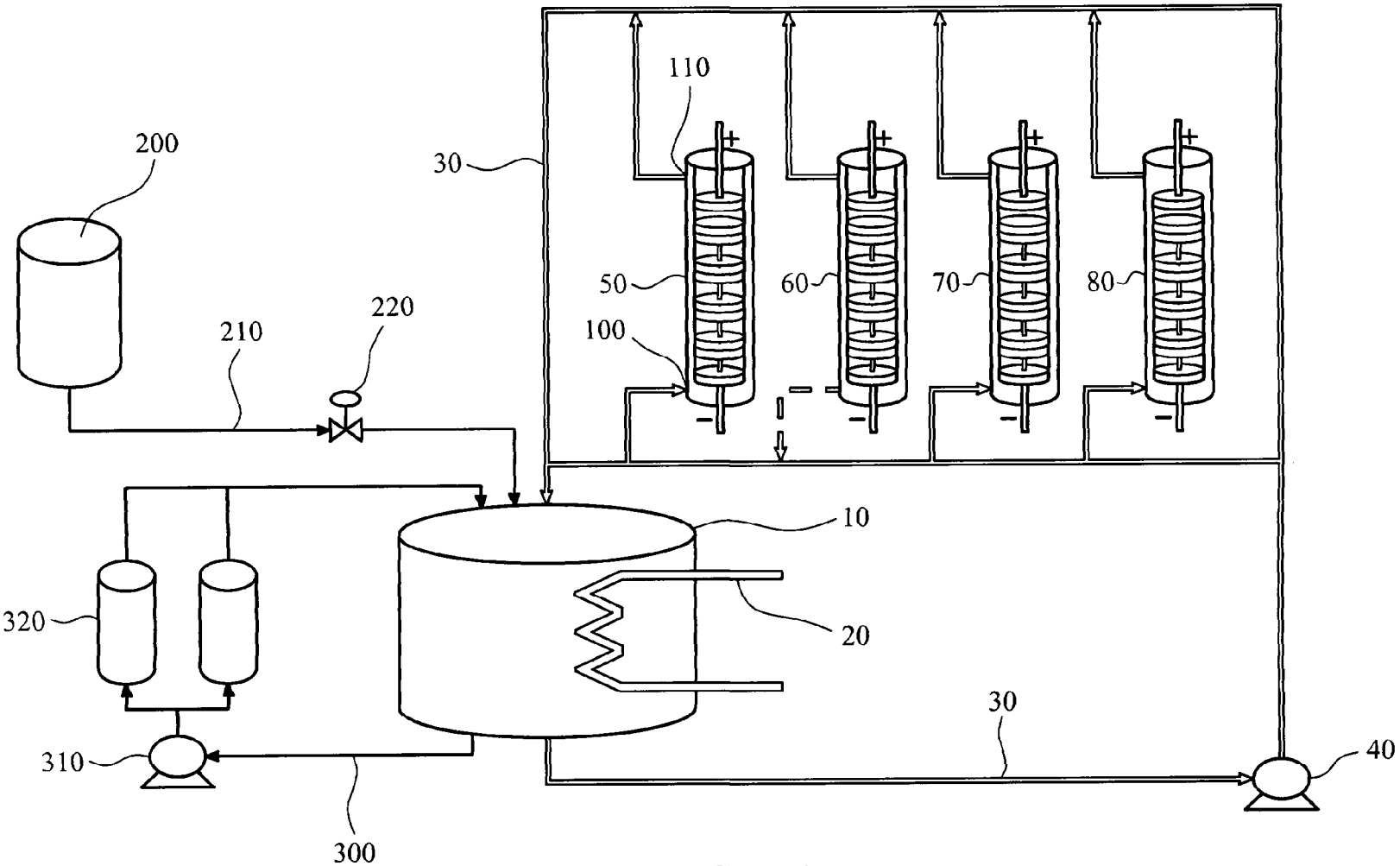
FIG. 1 is a schematic illustration of an apparatus according to a first embodiment of the invention.

FIG. 1 illustrates an apparatus according to a first embodiment of the invention. The apparatus comprises a molten salt reservoir 10 coupled to a heater 20 for heating and melting the salt in the reservoir and for maintaining the salt at a predetermined working temperature. A salt transport circuit 30 flowing out of and back to the reservoir 10 comprises stainless steel conduits or pipes and a transport circuit pump 40.

The molten salt circuit 30 is arranged to deliver molten salt from the reservoir 10 to each of a plurality of discrete electrolytic cells 50, 60, 70, 80. Each of the cells comprises a housing having a molten salt inlet 100 and a molten salt outlet 110, the inlet and the outlet being positioned at opposite ends of the housing such that molten salt can flow into the housing of each electrolytic cell through the inlet through the internal portion of the housing and out of the electrolytic cell via the outlet.

Figure 3:
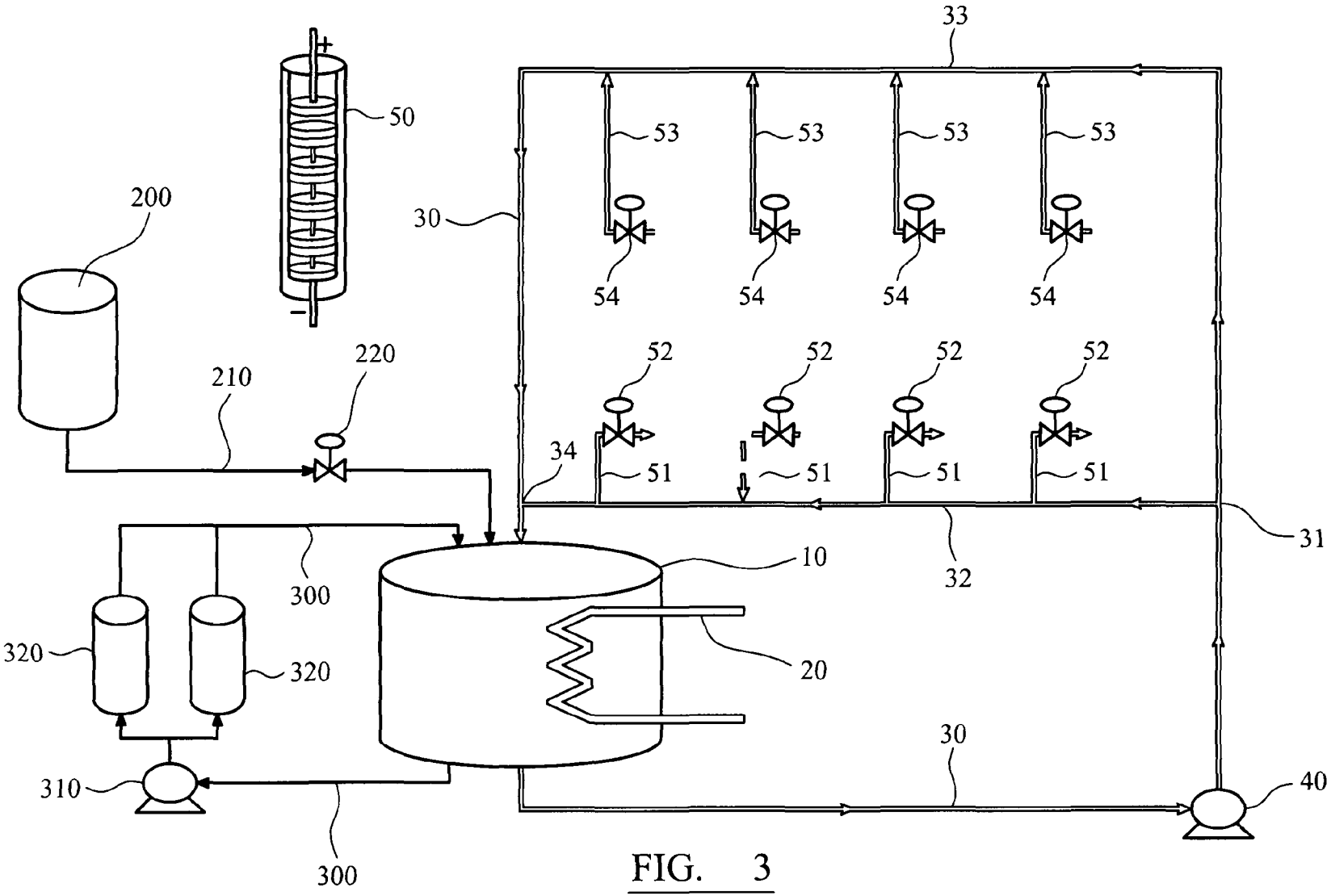
FIG. 3 is a schematic illustration of the apparatus of the first embodiment of the invention showing the electrolysis cell removed.

As shown in FIG. 3, the molten salt circuit 30 splits into two portions at a T-junction 31. One portion of the flow travels along a salt input channel 32 and the second part of the flow passes along a salt output channel 33. The salt input channel 32 and salt output channel 33 rejoin at a T-junction 34 prior to the salt re-entering the reservoir 10.

A plurality of cell feeder channels (generically denoted 51) extend from the salt input channel 32. Each feeder channel terminates in a coupling that allows connection of the channel with an inlet 100 of a cell. The flow of molten salt is regulated through each of these cell feeder channels by means of a valve 52.

A plurality of cell output channels 53, corresponding to the plurality of cell feeder channels 51, are coupled to the salt output channel 33. Each of these channels opens into the salt output channel 33 at one end, and is couplable to the outlet of an electrolytic cell at the other end. The flow of molten salt in each of the cell output channels is regulated by an outlet valve 54.

In this specific embodiment each electrolytic cell is a bipolar cell comprising a bipolar stack. An exemplary bipolar cell is described with reference to FIG. 2.

Figure 2:
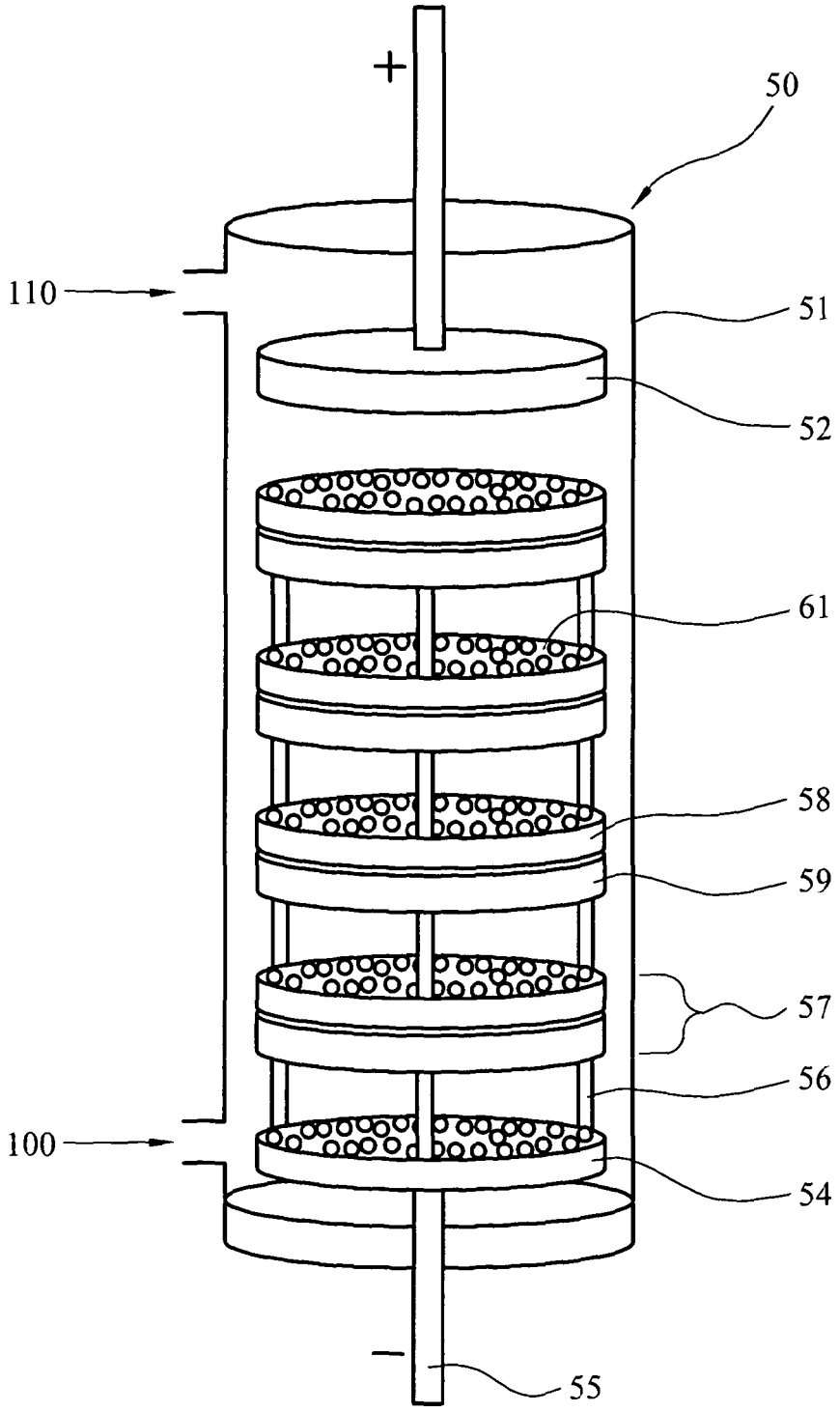
FIG. 2 is a schematic illustration of a bipolar electrolysis cell suitable for use with the first embodiment of the invention.

FIG. 2 is a schematic illustration of a bipolar electrolysis cell suitable for use with the first embodiment of the invention. The cell 50 comprises a substantially cylindrical housing 51 having a circular base of 150 cm diameter and a height of 300 cm. The housing has walls made of stainless steel defining an internal cavity or space, and an inlet 100 and an outlet 110 for allowing molten salt to flow into and out of the housing. The housing walls may be made of any suitable material. Such materials may include carbon steels, stainless steels and nickel alloys. The molten salt inlet 100 is defined through a lower portion of the housing wall and the molten salt outlet 110 is defined through an upper portion of the housing wall. Thus, in use, molten salt flows into the housing at a low point and flows upwardly through the housing eventually passing out of the housing through the outlet.

The internal walls of the housing are clad with an inert electrical insulator for example boron nitride or alumina to ensure that the internal surfaces of the housing are electrically insulating.

An anode 52 is disposed within an upper portion of the housing. The anode is a disc of carbon having a diameter of 100 cm and a thickness of 5 cm. The anode is coupled to an electricity supply via an electrical coupling 53 that extends through the wall of the housing and forms a terminal anode.

A cathode 54 is disposed in a lower portion of the housing. The cathode is a circular plate of an inert metal alloy, for example titanium, tantalum, molybdenum or tungsten having a diameter of 100 cm. The choice of cathode material may be influenced by the type of feedstock being reduced. The reduced product preferably does not react with or substantially adhere to the cathode material under cell operating conditions. The cathode 54 is connected to an electricity supply by an electrical coupling 55 that extends through a lower portion of the housing wall and forms a terminal cathode. The circumference of the cathode is bounded by an upwardly extending rim forming a tray-like upper surface to the cathode.

The upper surface of the cathode 54 supports a number of electrically insulating separating members 56 that act to support a bipolar element 57 directly above the cathode. The separating members are columns of boron nitride, yttrium oxide or aluminium oxide having a height of 10 cm. It is important that the separating members are electrically insulating and substantially inert in the operating conditions of the apparatus. The separating members must be sufficiently inert to function for an operating cycle of the apparatus. After reduction of a batch of feedstock during an operating cycle of the apparatus, the separating members may be replaced, if required. They must also be able to support the weight of a cell stack comprising a plurality of bipolar elements. The separating members are spaced evenly around the circumference of the cathode and support the bipolar is element 57 immediately above the cathode.

Each bipolar element 57 is formed from a composite structure having a cathodic upper portion 58 and an anodic lower portion 59. In each case the anodic portion is a disc of carbon of 100 cm diameter and 3 cm thickness and the cathodic upper portion 58 is a circular metallic plate having diameter of 100 cm and an upwardly extending rim or flange such that the upper portion of the cathodic portion 58 forms a tray.

The cell comprises ten such bipolar elements 80, each bipolar element supported vertically above the last by means of electrically insulating separating members 56. (For clarity only 4 bipolar elements are shown in the schematic illustration of FIG. 2.) The apparatus can comprise as many bipolar elements as are required positioned within the housing and vertically spaced from each other between the anode and the cathode, thereby forming a bipolar stack comprising the terminal anode, the terminal cathode and the bipolar elements. Each bipolar element is electrically insulated from the others. The uppermost bipolar element does not support any electrically insulating separating members and is positioned vertically below the terminal anode 52.

The upper surface of the terminal cathode and the upper surfaces of each of the bipolar elements act as supports for a solid feedstock 61.

Although the specific embodiment described herein relates to electrolytic cells using bipolar electrodes, the invention may be equally applicable to an apparatus utilising monopolar cells, i.e. cells having a simple anode and cathode structure.

Referring back to FIG. 1, the apparatus further comprises a reservoir for making up fresh melt 200. This serves as a top-up reservoir. The fresh melt reservoir 200 communicates with the main molten salt reservoir 10 via a conduit 210 and a valve 220. Actuation of the valve 220 allows melt from the fresh melt reservoir to pass into the main reservoir 10 in order to replenish levels of salt within the main reservoir.

A further circuit for molten salt flows out of, and back into, the reservoir 10 driven by a pump 310. This melt clean-up circuit 300 runs continuously during operation of the apparatus and comprises various purification means such as filtration means and electrolysis means to clean the salt from the reservoir 10 and re-circulate purified salt back into the reservoir.

The volume of salt contained within the main salt reservoir 10 is at least double the volume of the four electrolytic cells and the molten salt flow circuit combined.

In an exemplary method of using the apparatus as described above, the main salt reservoir 10 is loaded with calcium chloride. The reservoir is then heated to a temperature in excess of the melting point of calcium chloride (approximately 772° C.), typically 800° C. at which temperature the calcium chloride is fully molten. The molten or fused salt then undergoes a "pre-electrolysis" procedure in the reservoir 10 in order to eliminate undesirable excess water and/or other contaminants that the salt has picked up from the atmosphere. The salt reservoir is then held at the desired working temperature.

Where the apparatus is being used to reduce a metal oxide to its metal, for example to reduce titanium dioxide to titanium, suitable working temperatures may be between 800° C. and 1200° C.

There are two circuits for the flow of molten salt that originate at the salt reservoir 10 and flow back into the salt reservoir. One of these circuits passes the salt through conduits 300 and is pumped by a molten salt pump 310 through molten salt melt clean-up and purification devices. Once the salt in the molten salt reservoir 10 has reached its working temperature the continuous melt clean-up circuit is put into operation and continuously withdraws salt from the reservoir, passes it through various purification stages, and returns the purified salt to the reservoir.

A molten salt transport circuit is also defined by conduits 30 and driven by a molten salt pump 40. This molten salt transport circuit takes molten salt from the reservoir and returns the molten salt to the reservoir 10. Molten salt can be induced to flow through the transport circuit 30 by means of the salt pump 40. In the absence of any electrolytic cells within the circuit the inlet valves 52 and the outlet valves 54 are closed. This prevents molten salt from flowing out of the outlet channels 53 or the feeder channels 51, and the salt in this case circulates via the salt inlet channel 32 and the salt outlet channel 33 directly back to the reservoir 10.

The electrolytic cells of the apparatus 50 are removably-couplable to the molten salt flow circuit. Each cell is loaded with a charge of the solid feedstock, for example a charge of titanium dioxide, the cell inlets 100 are coupled to the terminal ends of the feeder channels 51, and the cell outlets 110 are coupled to the terminal end of the cell outlet channels 53.

Figure 4:
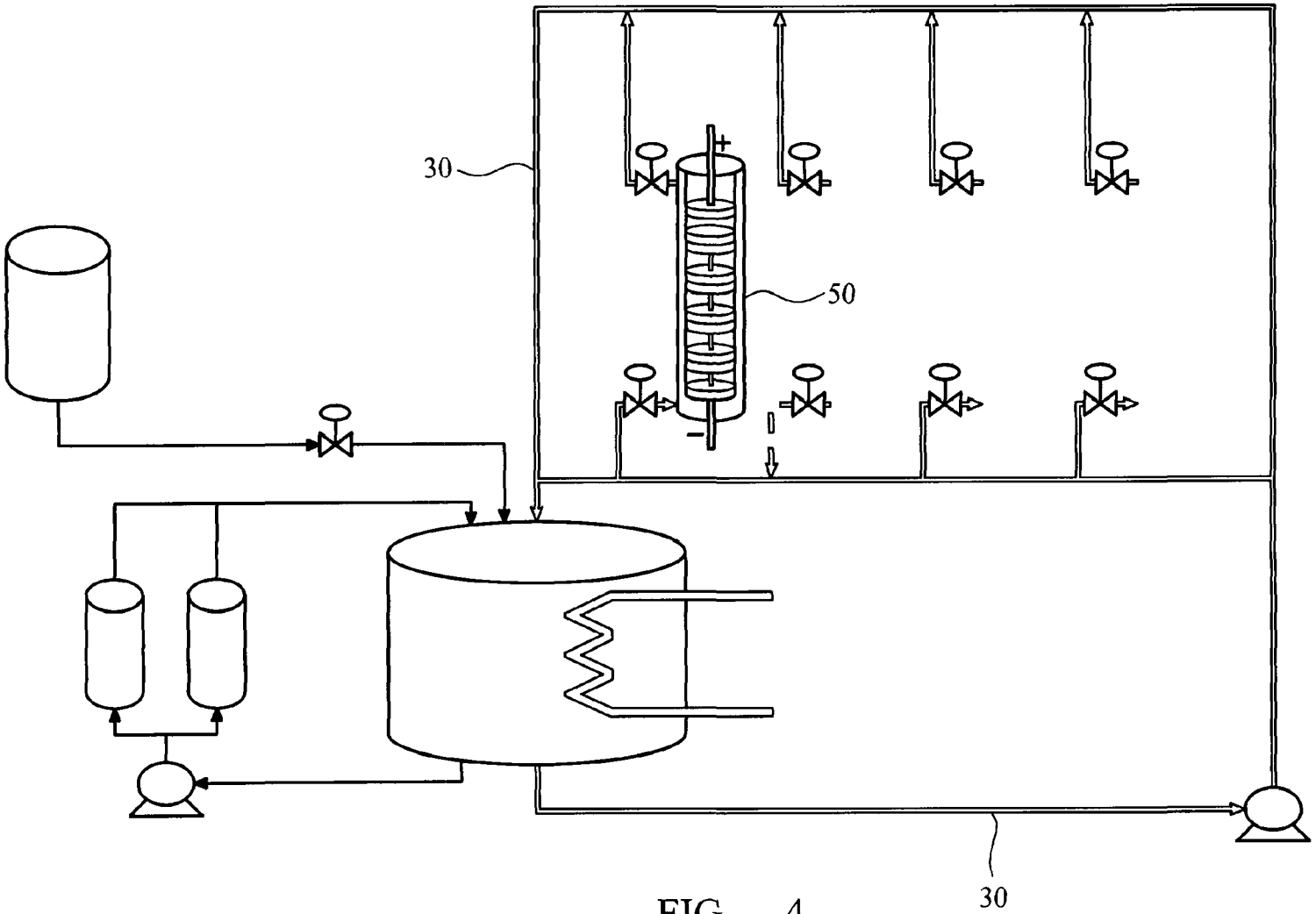
FIG. 4 is a schematic illustration of the apparatus of the first embodiment of the invention showing a single electrolysis cell coupled to the apparatus.

FIG. 4 illustrates an apparatus in which only one cell 50 is coupled to the salt transport circuit 30.

Once in position in the circuit the internal portion of each electrolytic cell 50 is warmed. This is achieved by means of passing hot gases through the cell, through a gas inlet channel at one end of the cell and a gas outlet channel at the other end of a cell (gas inlet and outlet channels not shown in the figures). Once the internal temperature of each electrolytic cell is up to a suitable working temperature, the inlet and outlet valves (52 and 54) may be opened to allow salt to flow through the electrolytic cell.

The positive and negative terminals of each electrolytic cell are connected to a power supply, and a suitable potential difference is applied between the terminal anode and the terminal cathode to reduce the solid feedstock.

Gases evolved during the production of the feedstock rise to the upper extremities of the electrolytic cell and are vented. Such vented gases are hot and, advantageously, may be recirculated to pre-heat newly recharged cells that are coming online at the start of a reduction cycle, or circulated through other forms of heat recovery system.

The molten salt flowing through the cell removes impurities formed during the electrolytic reaction of the feedstock and during reaction of the molten salt with various cell components, for example the internal portion of the housing or the anode or cathode materials. Thus, the salt returning to the salt reservoir 10 via the molten salt circuit 30 may be contaminated.

The large volume of the molten salt reservoir compared with the volume of the circuit and any electrolytic cell mounted within the circuit means that any impurities are relatively dilute within the salt. Furthermore, the continuous melt clean-up process helps remove solid and chemical impurities that may have contaminated the salt.

Each of a plurality of cells may be individually mounted, and thus the electrolytic reaction within each cell may have started at a different time. It follows that the electrolytic reduction in each cell may end at a different time. Once reduction in any cell is complete, the flow of molten salt can be stopped by closing the inlet and outlet valves (52 and 54). Molten salt within the cell may then be drained from the cell by means of an outlet or drainage valve or drainage port (not shown). The cell can then be swiftly cooled, for example by purging with an inert gas such as argon or helium, and the reduced feedstock within the cell may be recovered.

The use of a plurality of couplable and removable electrolytic cells allows a cell in which in a reaction has completed to be replaced almost immediately with a new cell filled with unreduced feedstock.

A proportion of molten salt is lost each time a cell is taken offline. While the salt drained from the cell may be returned directly to the reservoir 10, some salt would be lost by adhering to the internal surfaces of the electrolytic cell. Thus, the salt within the salt reservoir 10 is continuously topped up with fresh molten salt prepared in the fresh melt reservoir 200.

Figure 5:
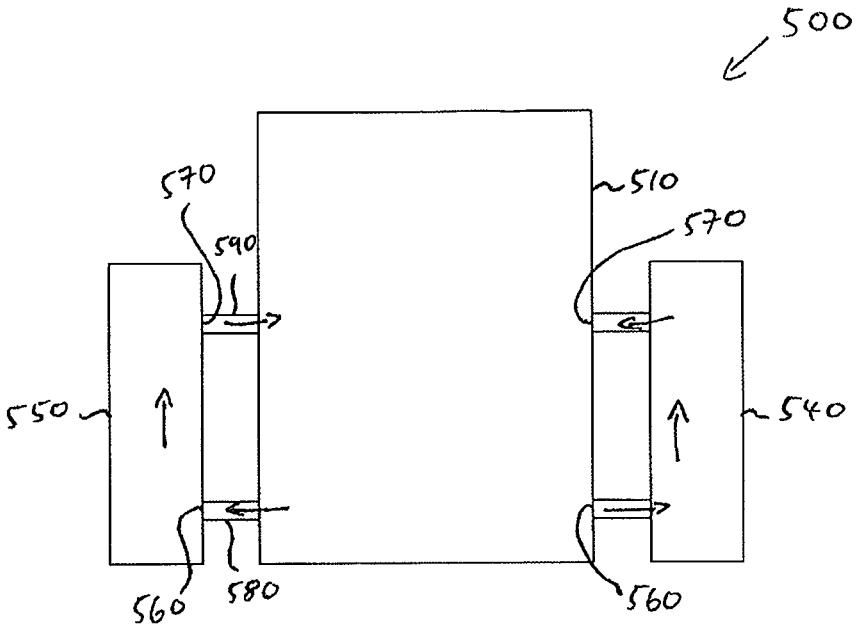
FIG. 5 is a schematic illustration of a second embodiment of the invention.
Figure 6:
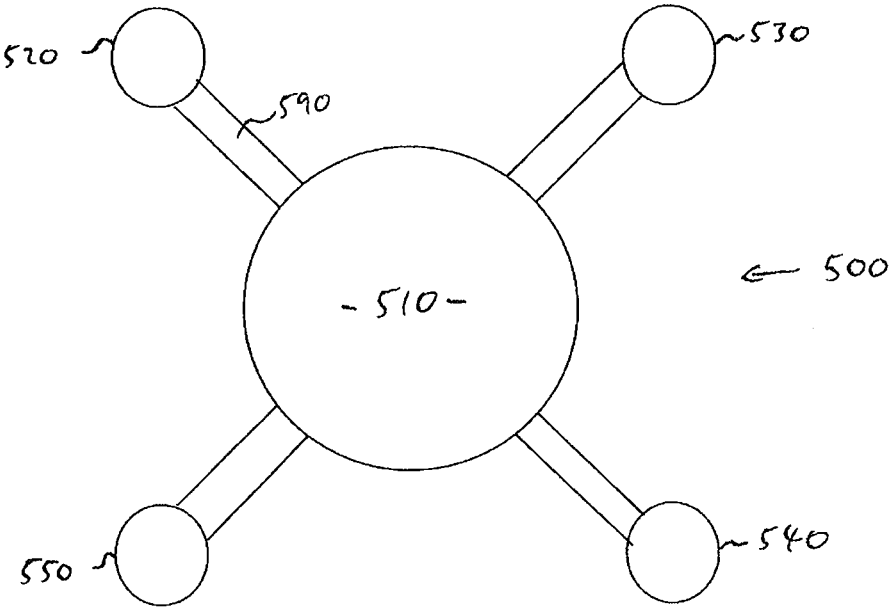
FIG. 6 is a schematic plan view of the second embodiment of the invention of FIG. 5.

FIGS. 5 and 6 illustrate an apparatus according to a second embodiment of the invention, similar to the first embodiment described above, but having a slightly different configuration of electrolytic cells. The apparatus 500 comprises a central molten salt reservoir 510 arranged to supply molten salt for circulation through is each of a plurality of discrete electrolytic cells 520, 530, 540, 550 spatially distributed around the reservoir 510. Each of the cells comprises a housing having a molten salt inlet 560 and a molten salt outlet 570, the inlet and the outlet being arranged at opposite ends of the housing such that molten salt can flow into the housing of each electrolytic cell through the inlet, through the internal portion of the housing and out of the electrolytic cell via the outlet.

Each of the cells has its own separate molten salt transport circuit comprising stainless steel tubing leading from the molten salt reservoir 580 and stainless steel tubing leading from the cell to the reservoir 590. Each molten salt transport circuit also includes a molten salt pump (not shown) for circulating molten salt. Thus, salt may be supplied to any one of the cells as required by activating the molten salt circuit associated with the cell. The salt in the reservoir may be maintained at constant temperature, and may be monitored to ensure the composition is maintained within defined tolerances.

Other details of the second embodiment of the invention are the same as described above in relation to the first embodiment of the invention. For example, each of the cells 520, 530, 540, 550 is a bipolar cell comprising a bipolar stack (as described above and as illustrated in FIG. 2).

Although the specific embodiments described herein utilise bipolar electrolytic cells contained within substantially cylindrical housings, it is clear that any electrolytic cell using molten salt as an electrolyte may be employed.

Furthermore, while the use of a single molten salt reservoir has been described, the use of two or more such reservoirs is envisaged to be within the scope of the invention. The source of molten salt flowing through electrolytic cells may be changed from a first reservoir to a second reservoir by the opening and closing of appropriate valves within the circuit or circuits. The advantages of using more than one molten salt reservoir, possibly containing more than one molten salt composition, have been discussed above.

We claim:

1. A method for reduction of a solid metal oxide feedstock in an electrolytic apparatus comprising the steps of, arranging a portion of the solid metal oxide feedstock in each of a plurality of electrolytic cells, circulating molten salt from a first molten salt reservoir such that salt flows through each of the electrolytic cells, and applying a potential across electrodes of each of the cells, the potential being sufficient to cause the reduction of the solid metal oxide feedstock in each of the cells.

2. The method according to claim 1, comprising the step of switching the flow of molten salt through the cells from salt contained in the first reservoir to salt contained in a second reservoir.

3. The method according to claim 2, comprising the step of maintaining the molten salt in the second molten reservoir at a predetermined level.

4. The method according to claim 2, comprising the step of maintaining the molten salt in the first and second molten salt reservoir at a predetermined level.

5. The method according to claim 2, in which the molten salt in the second molten salt reservoir is circulated through a purification apparatus to remove impurities and maintain the composition of the salt in the reservoir.

6. The method according to claim 2, in which the molten salt in the first and second molten salt reservoir is circulated through a purification apparatus to remove impurities and maintain the composition of the salt in the reservoir.

7. The method according to claim 1, in which the solid metal oxide feedstock is arranged in contact with a cathode or cathodic element in each of the plurality of electrolytic cells.

8. The method according to claim 1, comprising the step of removing an electrolytic cell containing reduced feedstock from the apparatus and replacing it with an electrolytic cell containing unreduced feedstock, the replacement of the cell taking place while molten salt continues to flow through other cells of the apparatus.

9. The method according to claim 1, comprising the step of maintaining the molten salt in the first molten salt reservoir at a predetermined level.

10. The method according to claim 1, in which the molten salt in the first molten salt reservoir is circulated through a purification apparatus to remove impurities and maintain the composition of the salt in the reservoir.

11. The method according to claim 1, in which the reduction of the feedstock occurs by electro-decomposition.

12. The method according to claim 1, in which molten salt is pumped through the cells, or in which molten salt flows from the first reservoir and through the cells under the influence of gravity.

13. The method according to claim 1, comprising the further step of pre-heating the cell before allowing molten salt to circulate through the cell.

14. The method according to claim 13, in which heating of the cell occurs by passing hot gas through the cell.

15. The method according to claim 13, in which heating of the cell occurs by resistance heating or induction heating.

16. An apparatus for the reduction of a solid metal oxide feedstock comprising a plurality of electrolytic cells, each cell having electrodes and containing a portion of the solid metal oxide feedstock, and a first molten salt reservoir from which molten salt can be circulated such that salt flows through each of the electrolytic cells, in which a potential sufficient to cause the reduction of the solid metal oxide feedstock can be applied across the electrodes of each cell.

17. The apparatus according to claim 16, in which each electrolytic cell comprises a housing having a molten salt inlet, a molten salt outlet, an anode positioned within the housing and a cathode positioned within the housing, in which the potential can be applied across the anode and the cathode of the cell.

18. The apparatus according to claim 16, in which a portion of the solid metal oxide feedstock is retained in contact with a cathode or a cathodic element in each of the plurality of electrolytic cells.

19. The apparatus according to claim 16, comprising at least one molten salt transport circuit for circulating molten salt.

20. The apparatus according to claim 19, comprising more than one molten salt transport circuit for circulating the molten salt from the first reservoir, through each of the plurality of cells, and back to the first reservoir, or comprising a single molten salt transport circuit for circulating the molten salt from the first reservoir, through each of the plurality of cells, and back to the first reservoir.

21. The apparatus according to claim 16, further comprising a second salt reservoir from which a second molten salt can be circulated through the plurality of cells.

22. The apparatus according to claim 21, further comprising purification apparatus for purification of the molten salt in the second salt reservoir and/or comprising a top-up salt reservoir for supplying fresh molten salt to maintain levels of salt in the first and/or second salt reservoir.

23. The apparatus according to claim 21, further comprising purification apparatus for purification of the molten salt in the first and second salt reservoir and/or comprising a top-up salt reservoir for supplying fresh molten salt to maintain levels of salt in the first and/or second salt reservoir.

24. The apparatus according to claim 21, comprising valves which allow the source of molten salt flowing through the cells to be switched from the first salt reservoir to the second salt reservoir and vice versa.

25. The apparatus according to claim 16, in which each of the cells is removably-couplable to a salt transport circuit.

26. The apparatus according to claim 25, in which the salt transport circuit comprises valves actuatable to selectably restrict salt flow to and from each cell to allow each cell to be exchanged while the apparatus is in operation.

27. The apparatus according to claim 16, in which the, or each, salt reservoir has a volume equal to or greater than a combined volume of all of the plurality of cells.

28. The apparatus according to claim 16, further comprising purification apparatus for purification of the molten salt in the first salt reservoir and/or comprising a top-up salt reservoir for supplying fresh molten salt to maintain levels of salt in the first and/or second salt reservoir.

29. The apparatus according to claim 16, having a molten salt circuit comprising a return portion for returning molten salt from the cells to the, or each, reservoir, the liquid flow being broken during the return portion to prevent electrical connection between the cells and the reservoir.

30. The apparatus according to claim 16, in which at least one electrolytic cell comprises a plurality of bipolar elements, one surface of each of the elements acting as a cathode.

* * * * *